US009901131B2

(12) United States Patent
Grilliot et al.

(10) Patent No.: US 9,901,131 B2
(45) Date of Patent: Feb. 27, 2018

(54) PROTECTIVE GLOVE

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 1494 days.

(21) Appl. No.: 11/796,883

(22) Filed: Apr. 30, 2007

(65) Prior Publication Data

US 2008/0263745 A1 Oct. 30, 2008

(51) Int. Cl.
*A41D 19/00* (2006.01)
*A41D 19/015* (2006.01)

(52) U.S. Cl.
CPC ..... *A41D 19/01529* (2013.01)

(58) Field of Classification Search
USPC ..... 2/16, 21, 159, 160, 161.1, 161.2, 161.5, 2/161.6, 163, 167
See application file for complete search history.

(56) References Cited

U.S. PATENT DOCUMENTS 1,841,193 A * 1/1932 Lorimer ..... 2/16
3,732,575 A * 5/1973 Pakulak ..... 2/16
3,997,922 A * 12/1976 Huhta ..... 2/161.1
4,000,524 A * 1/1977 Rinehart ..... 2/161.6
4,131,952 A * 1/1979 Brenning, Jr. ..... 2/16
5,376,066 A * 12/1994 Phillips et al. ..... 602/21
5,444,874 A * 8/1995 Samelian et al. ..... 2/159
5,504,942 A * 4/1996 Kuwahara ..... 2/163
5,644,797 A * 7/1997 Daneshvar ..... 2/161.7
5,857,216 A * 1/1999 Gold ..... 2/169
6,415,443 B1 * 7/2002 Schierenbeck et al. ..... 2/159
6,415,445 B1 * 7/2002 Nishijima et al. ..... 2/161.4
6,715,152 B2 * 4/2004 Mazzarolo ..... 2/161.6
6,839,912 B2 * 1/2005 Lewis ..... 2/161.6
6,957,448 B2 * 10/2005 Grilliot et al. ..... 2/161.6
7,478,440 B2 * 1/2009 Dolenak ..... 2/161.6
7,841,024 B2 * 11/2010 Son ..... 2/163
2002/0013961 A1 * 2/2002 Kleinert ..... 2/16
2003/0106133 A1 * 6/2003 Novak ..... 2/161.6
2004/0088776 A1 * 5/2004 Grilliot et al. ..... 2/161.6
2006/0253951 A1 * 11/2006 Mueller et al. ..... 2/16
2008/0263745 A1 * 10/2008 Grilliot et al. ..... 2/161.1

* cited by examiner

*Primary Examiner* — Sally Haden
(74) *Attorney, Agent, or Firm* — Wood, Phillips, Katz, Clark & Mortimer

(57) ABSTRACT

A protective glove (10) is provided and includes a palm face (12) that covers the palm side of the hand and fingers and a back face (14) that covers the back side of the hand and fingers. The back face (14) includes at least one seam (22,24,26) that defines a corresponding bubble space (32, 34,36) overlaying one of the knuckle joints in the hand. Each of the bubble spaces (32,34,36) provides an open area into which a corresponding knuckle joint can extend so as to improve flexibility of a user's hand and minimize fatigue.

6 Claims, 2 Drawing Sheets

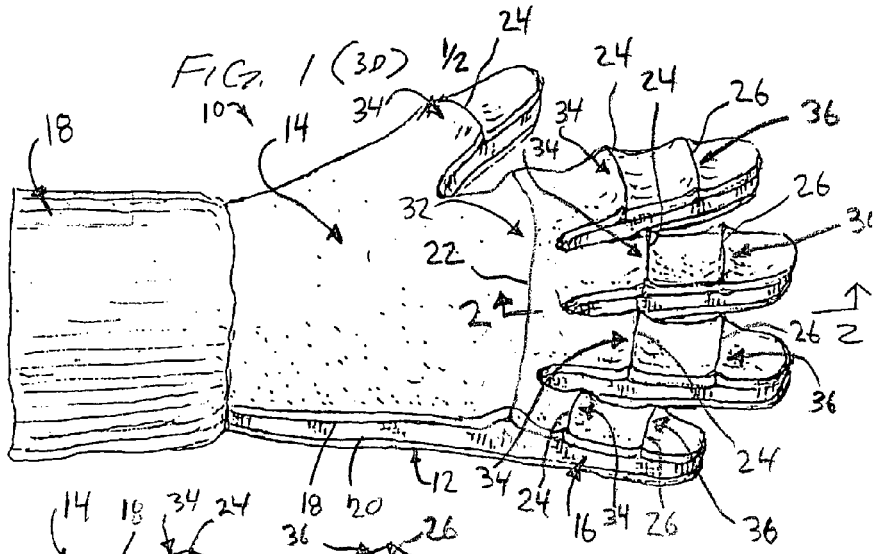
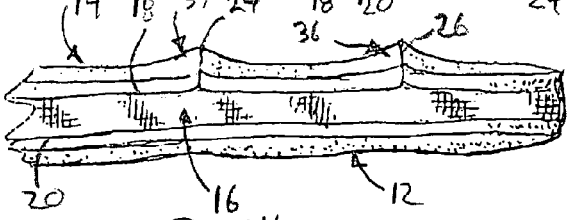
FIG. 2
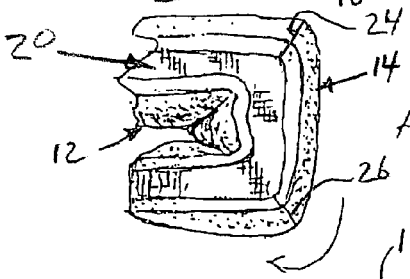
FIG. 3
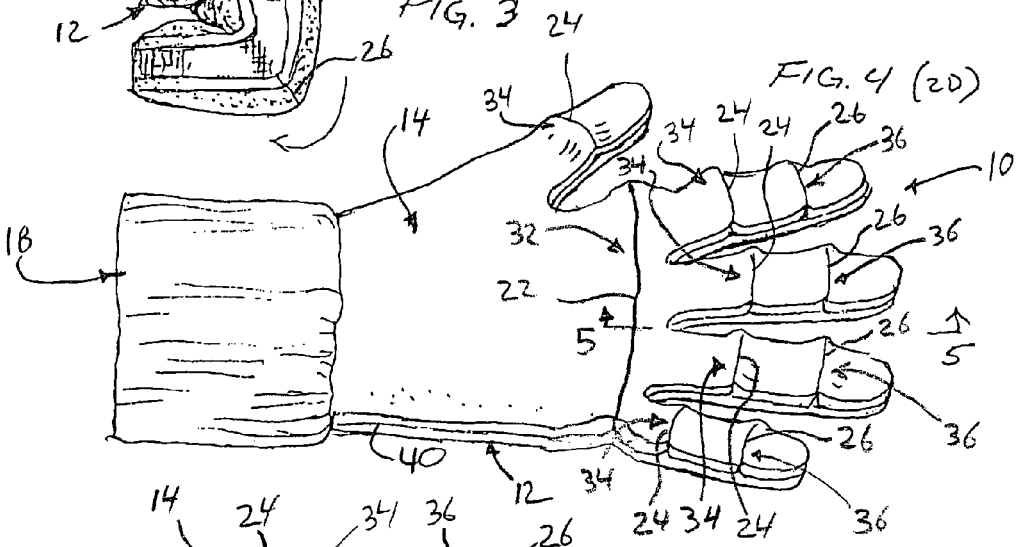
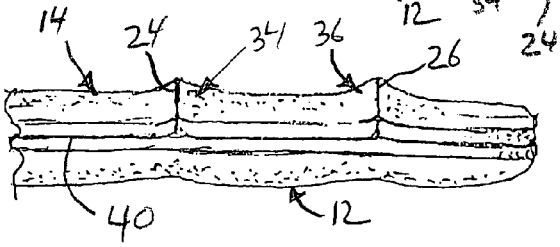
FIG. 5

PROTECTIVE GLOVE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to a protective glove for a firefighter, an emergency worker, or other first responder, wherein the glove is constructed to allow improved flexing of a user's hands/fingers.

BACKGROUND OF THE INVENTION

It is typical for firefighters and/or emergency workers to wear protective gloves to protect the user's hands from burns, abrasions, and other injury that may occur in a hazardous environment. It is important that such gloves do not impede the firefighter and/or emergency worker from effectively and/or efficiently using their hands to perform their required task. Furthermore, it is also important for such gloves to minimize the fatigue in a user's hands that can be generated over long periods of time of wearing such protective gloves while attempting to work in a hazardous environment. Thus, there is a continuing need to improve such protective gloves to allow increased flexibility for a user's hands.

SUMMARY OF THE INVENTION

According to one feature, the back face includes at least one seam located to overlay a knuckle joint in the hand, the at least one seam being defined by two edges that are joined to each other with the edges facing a common direction. Each edge has a convex crescent shape that is aligned with the convex crescent shape of the other edge.

In one feature, the back face includes at least one seam located to overlay a knuckle joint in the hand, the at least one seam defining two aligned, convex crescent shaped edges, the edges facing inwardly toward the hand when worn.

In one feature, the back face includes at least one seam located in a finger of the glove to overlay a knuckle joint in the hand, the at least one seam defining two aligned, convex crescent shaped edges, the edges facing inwardly toward a portion of the palm face directly opposite the at least one seam in the finger, the two edges being joined to each other along the convex crescent shape of the edges.

As one feature, the at least one seam includes a plurality of seams located in the fingers of the glove to overlay knuckle joints in the fingers.

According to one feature the at least one seam includes a continuous seam sized and located to overlay four metacarpophalangeal joints in a hand.

In one feature, the glove further includes a forchet joining the palm face and the back face.

According to one feature, the palm face and back face are connected directly to each other by a peripheral seam.

As one feature, the at least one seam is a stitched seam.

In accordance with one feature, the back face includes at least one seam defining a bubble space that overlays a knuckle joint in the hand.

According to one feature, the at least one seam includes a plurality of seams defining bubble spaces in the fingers of the glove that overlay knuckle joints in the fingers.

In one feature, the at least one seam includes a continuous seam defining a bubble space to overlay four metacarpophalangeal joints in a hand.

Other objects, features, and advantages of the invention will become apparent from a review of the entire specification, including the appended claims and drawings.

BRIEF DESCRIPTION OF THE DRAWINGS

FIG. 1 is a perspective view of a protective glove according to the invention as worn by a user;

FIG. 2 is a view taken from line 2-2 in FIG. 1 and showing the glove with the user's finger in an unflexed or straight position;

FIG. 3 is a view similar to FIG. 2, but showing the glove with a user's finger in a flexed position;

FIG. 4 is a perspective view similar to FIG. 1, but showing another embodiment of a protective glove according to the invention;

FIG. 5 is a view taken from line 5-5 in FIG. 4;

DETAILED DESCRIPTION OF THE PREFERRED EMBODIMENT

Figure 6:
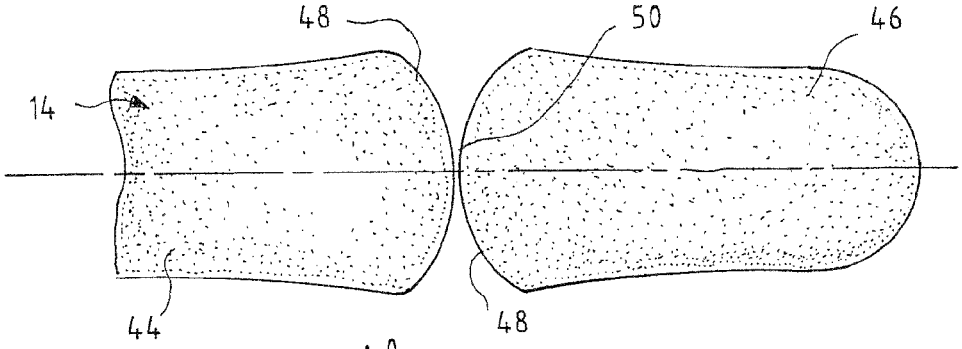
FIG. 6 is a plan view showing two portions of a back face of the glove that form in seam in the assembled glove.

With reference to FIGS. 1-3, a protective glove 10 as worn by a firefighter or emergency worker is shown and includes a palm face 12 that covers the palm side of the hand and fingers and a back face 14 that covers the back side of the hand and fingers, with a forchet 16 extending between and connecting the palm face 12 in the back face 14 of the glove 10 such as is known for so-called "3D" type glove constructions. The glove 10 also includes a suitable cuff 18 which can be of any suitable construction and the details of which are not critical to the invention described herein. Typically the forchet 16 will be joined to the back face 14 by a seam 18 that extends around the periphery of the glove, and joined to the palm face 12 by another seam 20 that extends around the periphery of the glove 10.

The glove 10 includes a plurality of seams 22, 24 and 26, each seam 22, 24 and 26 defining a corresponding bubble space 32, 34 and 36 that overlays one of the knuckle joints in the hand. More specifically, the seam 22 is sized and located to extend and define the buddle space 32 over all four of the base knuckle joints (metacarpophalangeal joints (MCP joints)) of the fingers of the hand, excluding the thumb. Each of the seams 24 is located in the glove to define the corresponding bubble space 34 over a corresponding one of the middle knuckle joints of the fingers (proximal interphalangeal joints (PIP joint)), and each of the seams 26 is located to define the corresponding bubble space 36 over one of the end knuckle joints (distal interphalangeal joints (DIP joint)) of the fingers.

Each of the bubble spaces 32, 34 and 36 provides an open area into which the corresponding knuckle joint can extend during flexing, such as shown in FIG. 3, so as to minimize fighting or stretching of the material of the back face 14 and/or compression of any insulation layer that may be provided within the outer shell of the glove 10.

FIGS. 4 and 5 are similar to FIGS. 1 and 2, with like numbers indicating like components, but show the inventive concept in a so-called 2-D glove construction wherein the palm face 12 and back face 14 are connected directly to each other by an edge seam 40 that extends around the periphery of the glove.

It is common for protective gloves, such as gloves 10 shown in FIGS. 1-5, to have an outer shell, which is shown in FIGS. 1-5, and inner liners that act as thermal barriers and/or moisture barriers. Preferably, the gloves 10 will conform to all applicable and current National Fire Protection Association standards, with the outer shell of the gloves 10 illustrated in the FIGS. 1-9 being made from a suitable material, many of which are known. Similarly, the materials for any inner layers that form a thermal barrier and/or a water/moisture barrier will also be made from suitable materials, many of which are known. Commonly assigned U.S. Pat. No. 6,427,250 issued Aug. 6, 2002, provides further details for some examples of suitable glove constructions and materials, and the entire specification is incorporated herein by reference.

Figure 7:
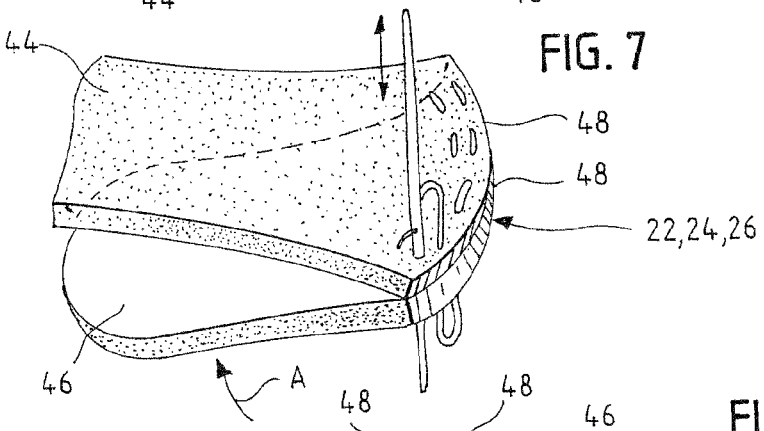
FIG. 7 is a perspective view of the two portions of FIG. 6 illustrating one method for joining the seam.
Figure 8:
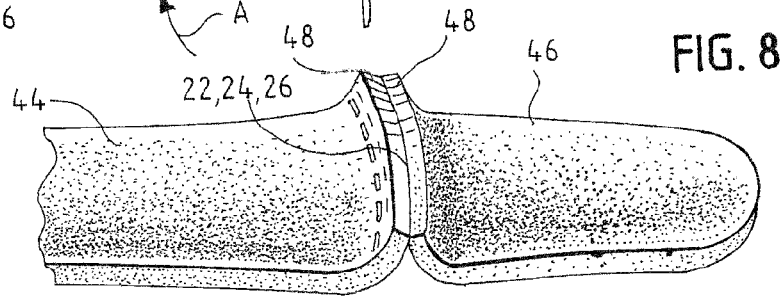
FIG. 8 is a perspective view showing the joined seam of FIG. 7.
Figure 9:
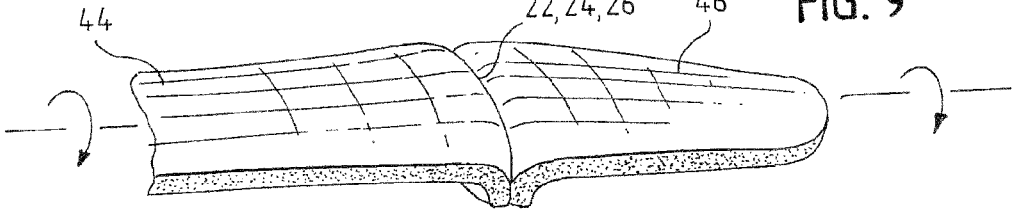
FIG. 9 is a perspective view showing the outer side of the seam of FIG. 8.

With reference to FIG. 6, the construction of one of the seams 22, 24 and 26 is illustrated wherein two portions 44 and 46 of the back face 14 are shown, each having a convex crescent-shaped edge 48. The portions 44 and 46 may either be completely separate from each other or they may be a single piece of material that is joined such as at 50. As seen in FIG. 7, to form one of the seams 22, 24 and 26, the convex crescent-shaped edges 48 are aligned with each other by folding the portions 44 and 46 as shown by arrow A. The two aligned convex crescent-shaped edges 48 are then attached using any suitable method, which will typically be by stitching with a needle and thread to form the connected seam 22, 24, 26 shown in FIG. 8 with the edges 48 facing in a common direction. Preferably, as shown in FIG. 9, the edges 48 face inwardly in the final construction of the glove 10. In the illustrated embodiment, the edges 48 abut each other along the convex crescent shape of the edges 48 and define the majority of the seam. The bubble spaces 32, 34 and 36 are produced by the convex crescent shape of the inwardly facing seams 22, 24, 26, with the back face 14 connected to the remainder of the glove 10. While it is preferred that the seams 22, 24, 26 face inwardly in the final construction of the glove 10, in some applications, it may be desirable for one or more of the seams 22, 24, 26 to face outwardly. Furthermore while it is preferred that each of the edges 48 have a convex crescent-shape, in some applications it may be desirable for only one of the edges 48 to have a convex crescent-shape, with the other edge 48 having a different shape such as, for example, a straight edge shape.

It should be understood that while the illustrated gloves show the seams 22, 24 and 26 at all of the various knuckle joints in a hand, in some applications it may be desirable to include only one of the seams 22, 24 and 26 or only certain groups of the seams 22, 24 and 26. For example, in some applications it may be desirable to have only the seam 22, while in other applications it may be desirable to have only the seams 24 on the four fingers of the hand, excluding the thumb. It should be understood that there are many other possible alternatives in this regard.

It should be appreciated that by using the aligned, convex crescent-shaped edges 48 to form the seams 22, 24 and 26, the bubble spaces 32, 34 and 36 can be provided in a relatively simply manner above each of the corresponding knuckles of a user's hand to allow for easier flexing of the hand and to minimize fatigue in the hand.

The invention claim is:

1. A protective glove for a firefighter or emergency worker, the protective glove comprising:

a palm face adapted to cover a palm side of a hand and fingers; and a back face adapted to cover a back side of a hand and fingers, the back face including at least one seam located in a finger of the glove to overlay a knuckle joint in the hand, the at least one seam defining two aligned, convex crescent shaped edges facing inwardly toward a portion of the palm face directly opposite the at least one seam in the finger of the glove, the two edges being joined to each other along the convex crescent shape of the edges.

2. The protective glove of claim 1 wherein the glove includes fingers and the at least one seam comprises a plurality of seams located in the fingers of the glove to overlay knuckle joints in the fingers of a hand when worn.

3. The protective glove of claim 1 wherein the at least one seam comprises a continuous seam sized and located to overlay four metacarpophalangeal joints in a hand.

4. The protective glove of claim 1 further comprising a forchet joining the palm face and the back face.

5. The protective glove of claim 1 wherein the palm face and back face are connected directly to each other by a peripheral seam.

6. The protective glove of claim 1 wherein the at least one seam is a stitched seam.

* * * * *